US008858187B2

(12) United States Patent
Lane

(10) Patent No.: US 8,858,187 B2
(45) Date of Patent: Oct. 14, 2014

(54) RECIPROCATING ROD PUMP FOR SANDY FLUIDS

(75) Inventor: William C. Lane, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 135 days.

(21) Appl. No.: 13/206,411

(22) Filed: Aug. 9, 2011

(65) Prior Publication Data

US 2013/0039780 A1 Feb. 14, 2013

(51) Int. Cl.

| | |
|---|---|
| ***F04B 43/12*** | (2006.01) |
| ***F04B 49/06*** | (2006.01) |
| ***F04B 53/12*** | (2006.01) |
| ***F04B 39/00*** | (2006.01) |
| ***F04B 53/20*** | (2006.01) |
| ***F04B 47/02*** | (2006.01) |

(52) U.S. Cl.

CPC ..... *F04B 47/02* (2013.01); *F04B 53/20* (2013.01)

USPC ..... 417/53; 417/555.2

(58) Field of Classification Search

CPC ..... F04B 53/126; F04B 53/14; F04B 53/143; F04B 47/00; F04B 47/02; F04B 47/005

USPC ..... 417/455.2, 554, 56, 60, 448, 437, 451, 417/481, 53, 555.2

See application file for complete search history.

(56) References Cited

U.S. PATENT DOCUMENTS

| | | | |
|---|---|---|---|
| 528,436 | A | 10/1894 | Jones |
| 1,313,245 | A | 8/1919 | Andrews |
| 1,338,829 | A | 5/1920 | Green |
| 1,545,475 | A | 7/1925 | Adams |
| 1,549,175 | A | 8/1925 | Adams et al. |
| 1,983,490 | A | 12/1934 | Penrod |
| 2,160,811 | A | 6/1939 | Adams |

(Continued)

FOREIGN PATENT DOCUMENTS

| | | | |
|---|---|---|---|
| WO | 95/34742 | A1 | 12/1995 |
| WO | 96/32599 | A1 | 10/1996 |

OTHER PUBLICATIONS

Profile Wire Screen Products; AMISTCO Separation Products, Inc., www.amistco.com, 2008.*

(Continued)

*Primary Examiner* — Devon Kramer

*Assistant Examiner* — Lilya Pekarskaya

(74) *Attorney, Agent, or Firm* — Wong, Cabello, Lutsch, Rutherford & Brucculeri LLP

(57) ABSTRACT

A downhole pump has a barrel and a plunger movably disposed therein. The gap between the barrel and plunger has first and second seals. The barrel and plunger each have a one-way valve restricting fluid passage out of it. A filter or screen is disposed on the plunger between the first and second seals. In a downstroke, fluid and particulate in the barrel transfers into the plunger. In an upstroke, fluid and particulate in the plunger lifts uphole. At the same time, a volume in the barrel fills with fluid and particulate. During either stroke, the first seal prevents particulate uphole of the plunger from passing into the gap. The filter or screen, however, prevents at least some particulate (i.e., most or larger particulate) inside the plunger from passing out of the plunger with fluid flowing into the gap between the first and second seals.

36 Claims, 6 Drawing Sheets

(56) References Cited

U.S. PATENT DOCUMENTS

| | | | | |
|---|---|---|---|---|
| 3,479,958 | A | 11/1969 | Anderson et al. | |
| 3,958,634 | A * | 5/1976 | Smith, III | 166/233 |
| 4,569,396 | A | 2/1986 | Brisco | |
| 4,621,987 | A * | 11/1986 | Spingath, Jr. | 417/313 |
| 4,968,226 | A * | 11/1990 | Brewer | 417/435 |
| 5,018,581 | A | 5/1991 | Hall | |
| 5,494,102 | A * | 2/1996 | Schulte | 166/105.6 |
| 5,494,109 | A * | 2/1996 | Schmitt | 166/312 |
| 5,660,534 | A | 8/1997 | Snow | |
| 6,116,613 | A * | 9/2000 | Friend et al. | 277/549 |
| 6,145,590 | A | 11/2000 | Havard | |
| 6,273,690 | B1 * | 8/2001 | Fischer et al. | 417/555.2 |
| 6,481,987 | B2 | 11/2002 | Ford | |
| 6,719,051 | B2 * | 4/2004 | Hailey et al. | 166/278 |
| 6,883,612 | B2 * | 4/2005 | Ferguson et al. | 166/369 |
| 6,905,114 | B2 | 6/2005 | Ford | |
| 6,926,504 | B2 | 8/2005 | Howard | |
| 6,945,762 | B2 | 9/2005 | Williams | |
| 6,966,248 | B2 | 11/2005 | Mahoney | |
| 7,008,197 | B2 | 3/2006 | Ford | |
| 7,404,702 | B2 | 7/2008 | Ford | |
| 7,428,923 | B2 | 9/2008 | Ford | |
| 7,458,787 | B2 * | 12/2008 | Brown | 417/555.2 |
| 7,686,598 | B2 * | 3/2010 | Williams | 417/430 |
| 7,909,589 | B2 | 3/2011 | Williams | |
| 2003/0056947 | A1 * | 3/2003 | Cameron | 166/65.1 |
| 2003/0056948 | A1 * | 3/2003 | Cameron | 166/206 |
| 2003/0075324 | A1 * | 4/2003 | Dusterhoft et al. | 166/279 |
| 2005/0226752 | A1 | 10/2005 | Brown | |
| 2005/0265875 | A1 | 12/2005 | Williams et al. | |
| 2006/0083646 | A1 | 4/2006 | Ford | |
| 2007/0154324 | A1 * | 7/2007 | Williams | 417/53 |
| 2008/0179560 | A1 | 7/2008 | Ford | |
| 2008/0217565 | A1 | 9/2008 | Ford | |
| 2009/0053087 | A1 | 2/2009 | Ford | |
| 2009/0068042 | A1 | 3/2009 | Ford | |
| 2011/0008180 | A1 * | 1/2011 | Williams | 417/53 |

OTHER PUBLICATIONS

Harbison-Fischer, "Rod Pumps and Accessories for Fluid Production with Sand and Particulates," Brochure HF-2-08-2, obtained from www.hfpumps.com, undated.

Ghareeb, M.. "The Advancements/Enhancements in the Area of Sucker Rod Pumping Applications," Lufkin Industries, Inc., obtained from http://egypt.spe.org/images/egypt/articles/150/The%20Advancements2.pdf, copyright 2010.

Lea, J. et al., "Part 1—Recent Developements are introduced in three major artificial lift categories: sucker rod pumping, progressing cavity pumping and gas lift," World Oil, vol. 229 No. 4, Apr. 2008.

Office Action Summary in counterpart Colombian Appl. 12.130.709, dated Sep. 26, 2013.

First Office Action in counterpart Canadian Appl. 2,784,421, dated Dec. 30, 2013.

* cited by examiner

RECIPROCATING ROD PUMP FOR SANDY FLUIDS

BACKGROUND

Many hydrocarbon wells are unable to produce at commercially viable levels without assistance in lifting the formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation and inhibits the unassisted flow of production fluid to the surface.

A common approach for urging production fluids to the surface uses a mechanically actuated, positive displacement pump. Reciprocal movement of a string of sucker rods induces reciprocal movement of the pump for lifting production fluid to the surface. For example, a reciprocating rod lift system 20 of the prior art is shown in FIG. 1A to produce production fluid from a wellbore 10. As is typical, surface casing 12 hangs from the surface and has a liner casing 14 hung therefrom by a liner hanger 16. Production fluid F from the formation 19 outside the cement 18 can enter the liner 14 through perforations 15. To convey the fluid, production tubing 30 extends from a wellhead 32 downhole, and a packer 36 seals the annulus between the production tubing 30 and the liner 14. At the surface, the wellhead 32 receives production fluid and diverts it to a flow line 34.

The production fluid F may not produce naturally reach the surface so operators use the reciprocating rod lift system 20 to lift the fluid F. The system 20 has a surface pumping unit 22, a rod string 24, and a downhole rod pump 50. The surface pumping unit 22 reciprocates the rod string 24, and the reciprocating string 24 operates the downhole rod pump 50. The rod pump 50 has internal components attached to the rod string 24 and has external components positioned in a pump-seating nipple 31 near the producing zone and the perforations 15.

As best shown in the detail of FIG. 1B, the rod pump 50 has a barrel 60 with a plunger 80 movably disposed therein. The barrel 60 has a standing valve 70, and the plunger 80 is attached to the rod string 24 and has a traveling valve 90. For example, the traveling valve 90 is a check valve (i.e., one-way valve) having a ball 92 and seat 94. For its part, the standing 70 disposed in the barrel 60 is also a check valve having a ball 72 and seat 74.

As the surface pumping unit 22 in FIG. 1A reciprocates, the rod string 24 reciprocates in the production tubing 30 and moves the plunger 80. The plunger 80 moves the traveling valve 90 in reciprocating upstrokes and downstroke. During an upstroke, the traveling valve 90 as shown in FIG. 1B is closed (i.e., the upper ball 92 seats on upper seat 94). Movement of the closed traveling valve 90 upward reduces the static pressure within the pump chamber 62 (the volume between the standing valve 70 and the traveling valve 90 that serves as a path of fluid transfer during the pumping operation). This, in turn, causes the standing valve 70 to unseat so that the lower ball 72 lifts off the lower seat 74. Production fluid F is then drawn upward into the chamber 62.

On the following downstroke, the standing valve 70 closes as the standing ball 72 seats upon the lower seat 74. At the same time, the traveling valve 90 opens so fluids previously residing in the chamber 62 can pass through the valve 90 and into the plunger 80. Ultimately, the produced fluid F is delivered by positive displacement of the plunger 80, out passages 61 in the barrel 60. The moved fluid then moves up the wellbore 10 through the tubing 30 as shown in FIG. 1A. The upstroke and down stroke cycles are repeated, causing fluids to be lifted upward through the wellbore 10 and ultimately to the earth's surface.

The conventional rod pump 50 holds pressure during a pumping cycle by using sliding mechanical and/or hydrodynamic seals disposed between the plunger's outside diameter and the barrel's inside diameter. Sand in production fluids and during frac flowback can damage the seals. In particular, the differential pressure across the seals causes fluid to migrate past the seals. When this migrating fluid contains sand, the seals can become abraded by the sand so the seals eventually become less capable of holding pressure. Overtime, significant amounts of sand can collect between the plunger and the barrel, causing the plunger to become stuck within the barrel.

Production operations typically avoid using such a rod pump in wellbores having sandy fluids due to the damage that can result. However, rod pumping in sandy fluids has been a goal of producers and lift equipment suppliers for some time. To prevent sand damage, screens can be disposed downhole from the pump 50 to keep sand from entering the pump 50 altogether. Yet, in some applications, using a screen in such a location may not be feasible, and the screen and the rathole below can become fouled with sand. In other application, it may actually be desirable to produce the sand to the surface instead of keeping it out of the pump 50.

One solution to deal with sandy fluids uses extra tight seals in the pump 50 to exclude the sand. In pumping operations, however, there will always be some fluid leakage due to the pressure differential so eventually the sand will wear the seal. Extra loose hydrodynamic seals with long sealing surfaces are sometimes used to let sand pass. These long, loose hydrodynamic seals can extend the life of the pump because the longer seals can accommodate more damage than conventional rod pumps. However, damage still occurs; there is just more sacrificial surface to accept the damage. Thus, the life of the pump is extended even though damage continues.

Another solution to deal with sandy fluids shown in FIG. 2A uses a rod pump 50 as disclosed in U.S. Pat. No. 2,160,811. As before, the rod pump 50 has a plunger 80 disposed in a barrel 60 and has a standing valve 70 and a traveling valve 90. An upper sealing zone 84*a* between the plunger 80 and barrel 60 has hard metal rings 85 that engage inside the barrel 60. A lower sealing zone 84*b* uses the sliding cooperation between the barrel 60 and the plunger 80 to form a fluid seal. A chamber 86 is disposed between the two sealing zones 84*a-b* to deal with sand that may collect uphole of the plunger 80. This chamber 86 is maintained in communication with the interior 82 of the plunger 80 using circumferentially spaced ports 83.

During a downstroke of the plunger 80, the chamber 86 decreases in volume, and fluid displaces from the chamber 86 through the ports 83 and into the interior 82 of the plunger 80. Thus, any sand and silt that may have entered the chamber 86 through the upper sealing zone 84*a* is discharged into the plunger 80 to be removed with the main body of fluid. In this way, the sand or silt is prevented from reaching the lower sealing zone 84*b* and causing damage during a subsequent upstroke.

In a related solution to the rod pump 50 of FIG. 2A, a sand snare chamber can be used in the rod pump. For example, the Harbison-Fischer Sand-Pro® pump disclosed in U.S. Pat. Nos. 7,686,598 and 7,909,589 has a plunger with a sand snare chamber defined in its walls to catch the sand. (SAND-PRO is a registered trademark of Harbison-Fischer, Inc. of Crowley, Tex.) FIG. 2B shows an example of such a rod pump 50 having a sand snare chamber 100.

Again, the pump 50 has a barrel 60 with a plunger 80 located therein and has standing and traveling valves 70 and 90. The plunger 80 has a first portion 83 having a first seal 84*a* with the barrel 60, and the plunger 80 has a third portion 87 having a second seal 84*b* with the barrel 60. The first seal 84*a* has resilient members, while the second seal 84*b* is a fluid seal. An opening 81 at the top of the plunger 80 allows lifted fluid to pass up the barrel 60 and the production tubing (not shown) to be produced.

In between the first and second portions 83 and 87, the plunger 60 has a second portion 85 that forms a balancing chamber 86 between the barrel 60 and the plunger 80. The plunger's second portion 85 also has an opening 88 to allow communication between the plunger's interior 82 and the balancing chamber 86. A wall 89 is located relative to the opening 88 and forms a sand snare chamber 100 between the balancing chamber 86 and the plunger interior passage 82.

To pump fluid from a sandy well, the plunger 80 reciprocates with respect to the barrel 60. Pressure equalizes across the first seals 84*a* by venting pressure from inside of the plunger 82 to outside of the plunger 80 in the balancing chamber 86 between the two seals 84*a-b*. In the meantime, the pump 50 uses the wall 89 to capture sand from the fluid exiting the opening 88 in the sand snare chamber 100. This collection isolates the sand from the sets of seals 84*a-b* to reduce wear.

Unfortunately, the sand snare chamber 100 on the pump 50 has some drawbacks. For example, the volume available to collect sand can be limited. In addition, the chamber 100 can create turbulence during pumping which can tend to keep the sand flushed out of the sand snare chamber 100 and into the sealing areas 84*a-b*.

The subject matter of the present disclosure is directed to overcoming, or at least reducing the effects of, one or more of the problems set forth above.

SUMMARY

A downhole pump has a barrel and a plunger movably disposed therein. The barrel has a first one-way valve restricting fluid passage out of the barrel. The plunger is reciprocally disposed relative to the barrel and has first and second seals formed in a gap between the plunger and the barrel. The plunger also has a second one-way valve restricting fluid passage out of the plunger and into a variable volume defined between the first and second one-way valves.

The first seal can have wiper seals disposed on the plunger and engaging inside the barrel. The second seal is preferably a hydrodynamic seal formed by fluid in a gap between the plunger and barrel. A filter or screen is disposed on the plunger between the first and second seals, and the filter or screen restricts at least some particulate (i.e., most particulate or larger particulate) inside the plunger from passing into the gap.

In a downstroke, a first volume of fluid and particulate trapped in the barrel transfers into the plunger through the traveling valve as the plunger reciprocates downhole in the barrel. In an upstroke, a second volume of fluid and particulate trapped in the plunger lifts uphole in the production tubing as the plunger reciprocates uphole in the barrel. At the same time, the first volume fills with fluid and particulate as the standing one-way valve opens and the chamber fills due to the reduced pressure produced therein.

During either stroke, the first seal prevents particulate uphole of the plunger from passing into the gap between the plunger and the barrel. The filter or screen, however, prevents (most or larger) particulate inside the plunger from passing out of the plunger with fluid flowing into the gap between the first and second seals. This primarily occurs during the upstroke when some of the fluid in the plunger is allowed to pass through the filter or screen and into the gap to maintain the hydrodynamic seal between the plunger and barrel.

The foregoing summary is not intended to summarize each potential embodiment or every aspect of the present disclosure.

DETAILED DESCRIPTION

Figures 1A, 1B:
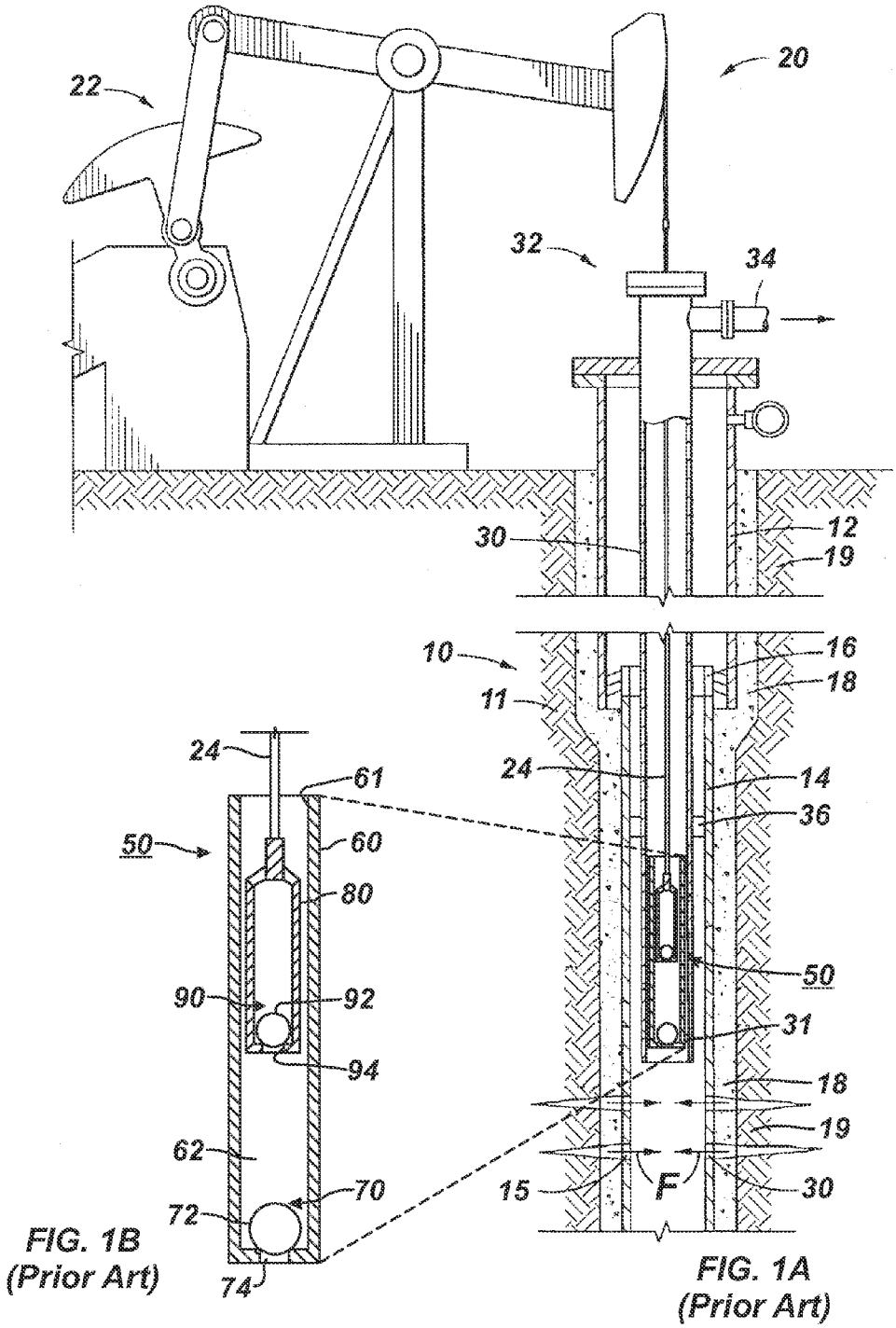
FIG. 1B (Prior Art)
FIG. 1A (Prior Art)
FIG. 1A illustrates a reciprocating rod lift system having a rod pump according to the prior art.
FIG. 1B illustrates a detailed cross-sectional view of the rod pump of FIG. 1A.
Figure 2A:
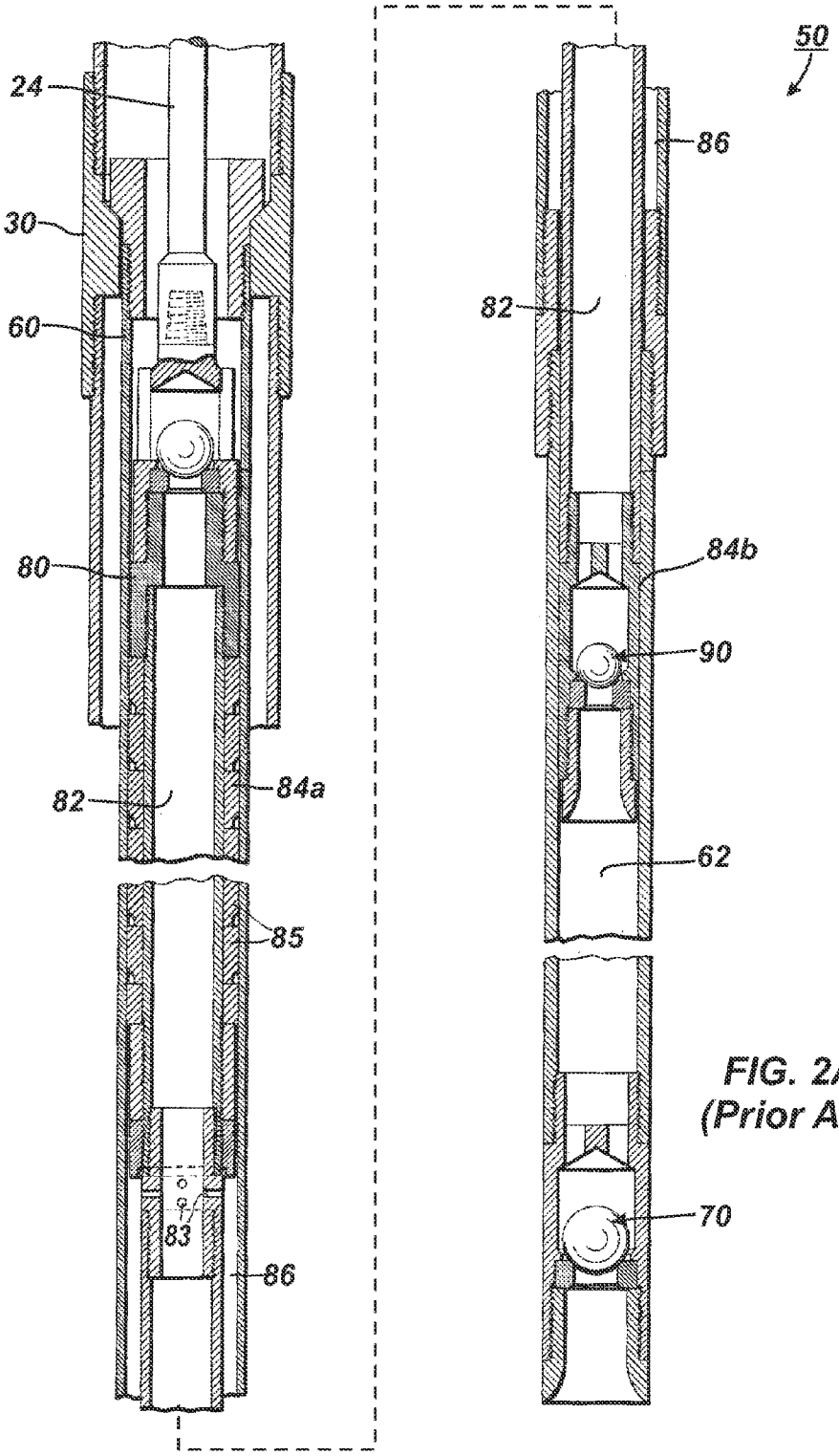
FIG. 2A (Prior Art)
FIG. 2A illustrates a rod pump having a balancing chamber according to the prior art for use in a sandy well.
Figure 2B:
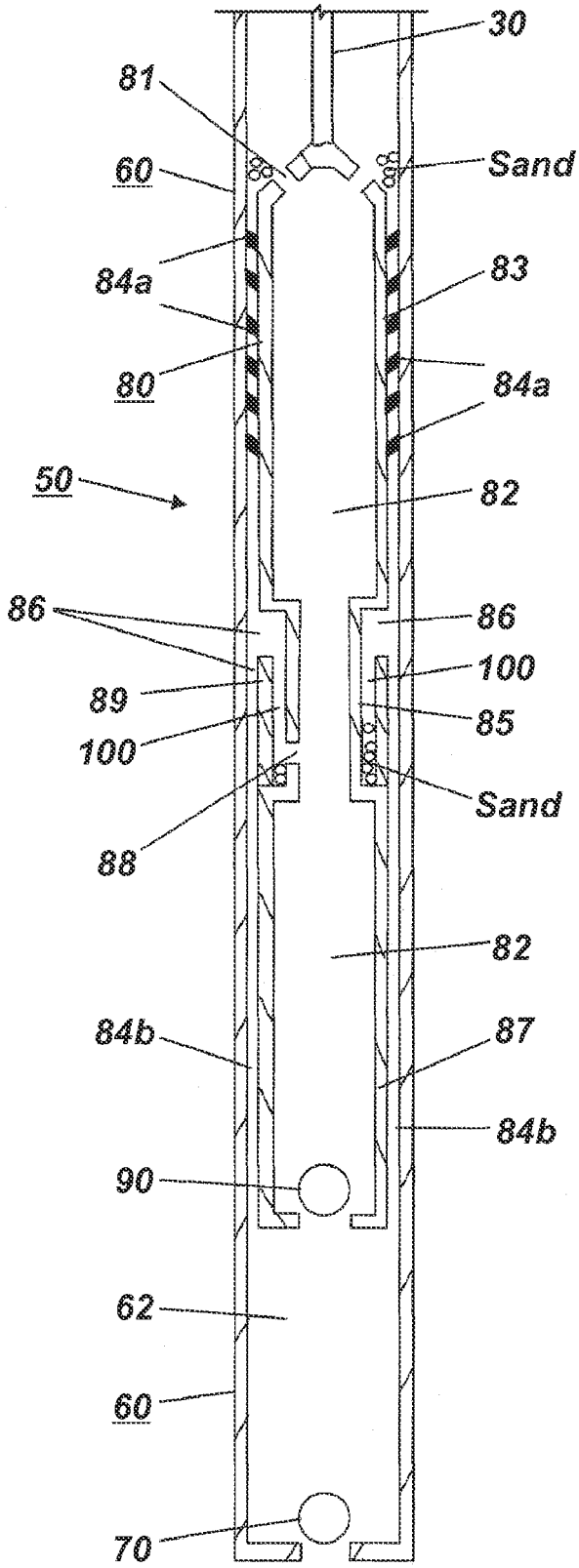
FIG. 2B (Prior Art)
FIG. 2B illustrates a rod pump having a sand snare chamber according to the prior art for use in a sandy well.
Figure 3:
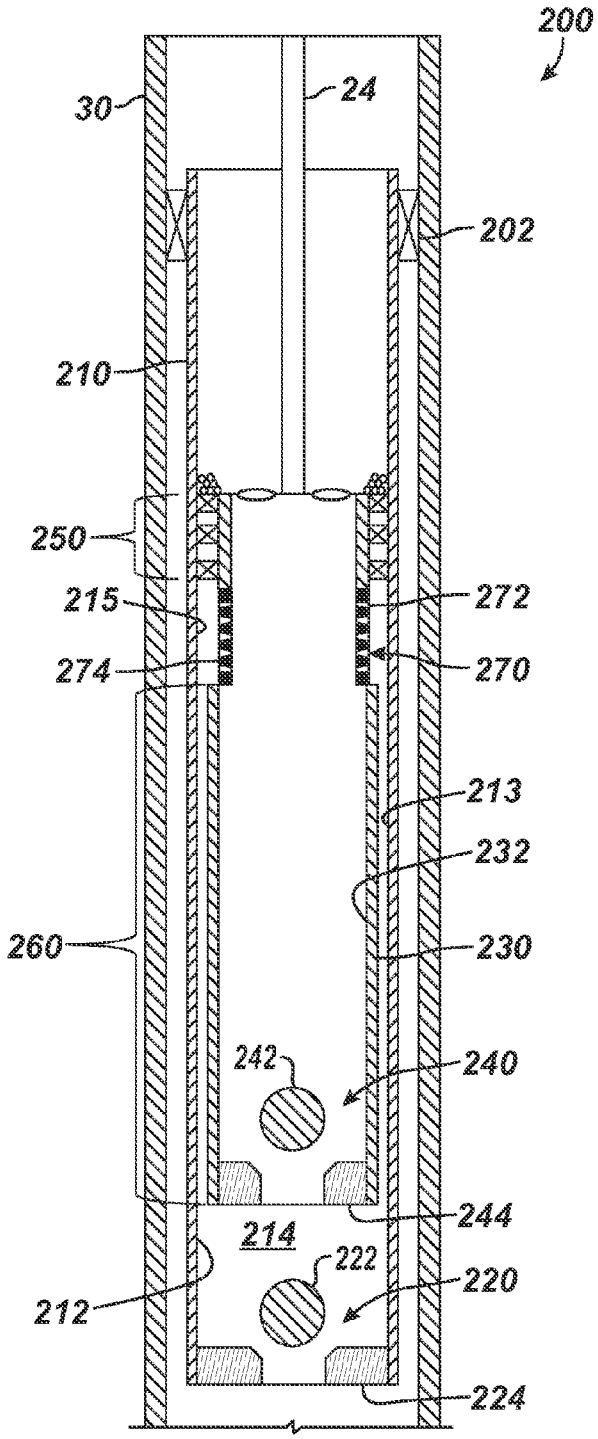
FIG. 3 illustrates a rod pump according to the present disclosure for use in a sandy well.

A rod pump 200 in FIG. 3 can be used with a reciprocating rod system, such as described previously, to lift production fluids of a well to the surface. The pump 200 can produce sand with the production fluid while preventing the sand from entering sealing areas on the pump 200. As shown, the pump 200 has a barrel 210 with a plunger 230 movably disposed therein. The components of the pump 200 are schematically shown and are composed of suitable materials, housings, couplings, and the like as known in the art. The barrel 210 disposes in production tubing 30 with a pump seating nipple 202 or other component as conventionally done, and the plunger 230 disposes for reciprocal movement with an attached rod 24 in the barrel 210.

The barrel 210 has a standing one-way valve 220 that restricts passage of fluid out of the barrel 210, and the plunger 230 has a traveling one-way valve 240 that restricts passage of fluid out of the plunger 230. Both valves 220 and 240 can be ball check valves have a ball 222 and 242 movable relative to a corresponding seat 224 and 244. Other types of one-way valves could be used, however.

The barrel 210 defines an interior 212 in which the plunger 230 is disposed, and the plunger 230 defines an interior 232 as well. The standing valve 220 permits fluid flow from the production tubing 30 to flow into the barrel's interior 212, but restricts fluid flow in the opposite direction. The traveling valve 240 permits fluid flow from the barrel's interior 212 (and especially a variable volume 214 between the valves 220 and 240) to enter the plunger's interior 232, but restricts fluid flow in the opposite direction A gap 213 is formed between the plunger 230 and the barrel 210 and has first and second seals 250 and 260. The uphole seal 250 is a mechanical seal having pressure-balanced wiper seals or similar types of seals that dispose about the outside of the plunger 230 and engage inside the barrel 210. During operation, the wiper seals 250 keep produced sand uphole of the pump 200 from entering the gap 213 between the plunger 230 and barrel 210.

The downhole seal 260 can be any type of suitable seal. As shown in FIG. 3, the downhole seal 260 is a fluid or hydrodynamic seal that uses the fluid trapped in the gap 213 to hold pressure. The outside surface of the plunger 230 (especially at the seal 260) can be hardened with a coating or the like to increase resistance to wear. Typically, the inside surface of the barrel 210 and the outside surface of the plunger 230 have a tight clearance to create the fluid seal 260. The actual clearance can depend in part on the type of fluid to be encountered, such as heavy or light crude, expected particulate sizes, and other details of the pump 200 as discussed below. The fluid seal 260 can be a long hydrodynamic seal effective in extending the life of the pump 50.

Interposed between the seals 250 and 260, the plunger has a filter 270. Fluid can pass through openings 272 in the filter 270 into the gap 213 for pressure balance. A region 215 of the gap 213 surrounding the filter 270 defines a pressure-balancing region that allows pressure to balance across the first seal 250. This region 215 may or may not define a wider portion of the gap 213 depending on the implementation.

Although fluid can pass through, the filter 270 restricts passage of at least some of the particulates inside the plunger 230 from passing into the gap 213. (It will be appreciated that the filter 270 may not restrict passage of all particulate therethrough. Yet, the filter 270 can be configured to restrict the passage of most particulate or at least larger particulate for a given implementation.) The filter 270 can be a wire-wrapped screen, a perforated tubular portion, a mesh screen, or any suitable type of barrier, medium, or the like for restricting passage of particulate matter, such as sand, in downhole production fluid. Preferably, the filter 270 is a slotted, wire-wrapped screen having a circumferentially wound wire 274 forming a number of slots for the openings 272. The wrapped wire 274 can be profiled V-wire and allows the slot's dimension to be precisely controlled. The narrower portion of the slotted openings 272 preferably face the interior 232 of the plunger 230 to help prevent particulate passing through the screen filter 270 from wedging in between the wires 274 as it passes out to the gap 213.

Figure 4A:
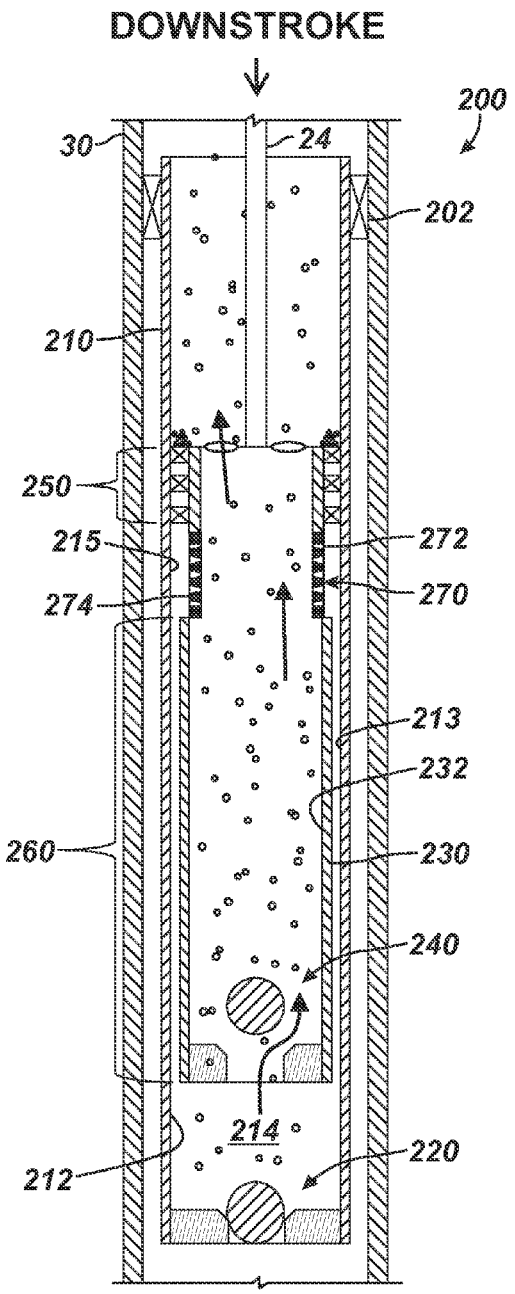
FIG. 4A illustrates the rod pump of FIG. 3 during a downstroke.

Produced fluid from the formation enters the production tubing 30 downhole of the pump 200. As the reciprocating rod system reciprocates the rod 24 attached to the plunger 230, the produced fluid is lifted above the pump 200 and is eventually produced at the surface. During a downstroke by the rod as shown in FIG. 4A, for example, the standing valve 220 closes. At the same time, the traveling valve 240 opens so fluids previously residing in the variable volume chamber 214 can pass through the valve 240 and into plunger's interior 232.

Rather than screening the production fluid before it enters the barrel's chamber 214, the pump 200 allows sand to enter the barrel 210 so it can eventually be produced with the production fluid that has collect in the chamber 214. This means that produced sand collects in the lifted column of fluid above the pump 200 so the pump 200 must prevent the produced sand from entering sealing areas on the pump 200 during operation.

During the downstroke, the wiper seals 250 maintain a barrier between the uphole and downhole portions of the pump 200 and keeps produced sand above the pump 200 from entering the gap 213 between the plunger 230 and barrel 210. Head pressure is present inside the barrel 210 above and below the plunger 230, inside the plunger 230, and in the pressure-balance region outside the filter 270 below the wiper seals 250. (As is known, head pressure refers to the pressure exerted by weight of the column of fluid above a given point.) Therefore, pressure is balanced across the first seals 250 so that there is no slippage (i.e., fluid does not pass between the seal 250 and the surrounding surface of the barrel 210 engaged thereby). At the same time, pressure is also balanced across the second seal 260 in the gap 213 so that there is no slippage either.

Figure 4B:
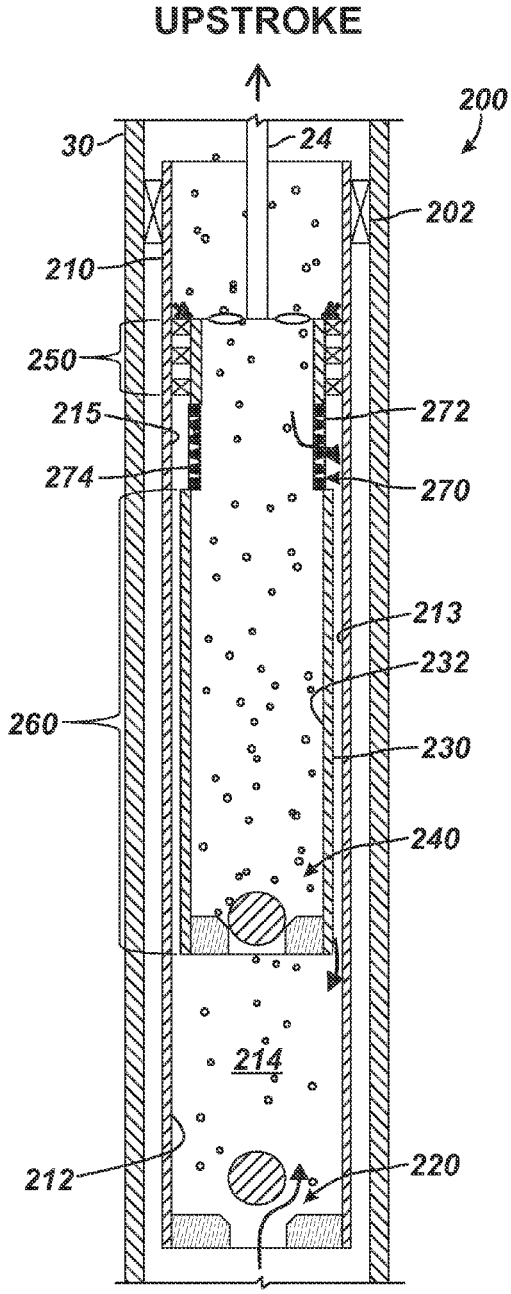
FIG. 4B illustrates the rod pump of FIG. 3 during an upstroke.

During the upstroke by the rod 230 as shown in FIG. 4B, the traveling valve 240 closes, and movement of the closed traveling valve 240 upward creates reduced pressure within the pump chamber 214. In turn, the standing valve 220 opens so production fluids and any sand downhole of the pump 200 can be drawn into the chamber 214. Head pressure is present inside the barrel 210 above the plunger 230 and in the pressure-balance region 215 outside the filter 270 below the wiper seals 250. As before, the wiper seals 250 are pressure-balanced so there is no slippage. In this way, the wiper seals 250 maintain the barrier between the uphole and downhole portions of the pump 200 and keep produced sand above the pump from entering the gap 213 between the plunger 230 and barrel 210.

During the upstroke, fluid slippage can occur in the gap 213 between the inside of the barrel 210 and the outside of the plunger 230, and fluid flows from the interior 232 of the plunger 230 to the gap 213 through the filter 270 to maintain the hydrodynamic seal 260. As a result, a pressure differential occurs, reducing the pressure in the expanding chamber 214 to draw new production fluid and sand into the barrel 210 past the standing valve 220.

As noted above, the filter 270 allows some of the lifted fluid in the plunger's interior 232 to pass through and enter the gap 213 to maintain the hydrodynamic seal 260. Yet, the filter 270 limits the size of particulate matter that can enter the hydrodynamic sealing gap 213. In this way, larger particulates cannot enter the gap 213 and abrade the surfaces, which would compromise the pumps operation. The gap 213 is preferably sized larger than the particulate matter permitted to pass through the filter 270 so that the screened matter can pass through the hydrodynamic sealing gap 213 without abrading the sealing surfaces forming the seal 260. To achieve this, the average clearance of the gap 213 is preferably equal to or greater than the width of the openings 272 (i.e., slots) in the filter 270 and any particulates that the filter 270 may pass. For example, the filter 270 can be a screen having slots for the openings 272, and the slot size may be as small as 0.006-in. Thus, the difference between the barrel's ID and the plunger's OD is preferably greater than 0.012-in. This would produce a gap 213 with an average clearance of about 0.006-in. around the inside of the barrel 210 and the outside of the plunger 230. Particulates larger than 0.006-in. that could cause damage if they were to pass in the gap 213 are instead restricted by the filter 270. Meanwhile, fluid flow for pressure balancing and any smaller particulates (i.e., less than 0.006-in.) can still pass through the openings 272 in the filter 270 and into the gap 213.

The upstroke and down stroke cycles of FIGS. 4A-4B are repeated, causing fluids to be lifted upward through the production tubing 30 and ultimately to the earth's surface. Flow through the pump 200 continuously washes the interior surface of the filter 270, which can keep it from fouling. With this arrangement, sandy fluids produced from the formation will produce less wear on the sealing surfaces. Being able to lift the sand with the production fluids means that any produced sand below the pump 200 will not foul a downhole screen or fill up the rathole.

As noted previously, the filter 270 installs at the pressure-balancing region of the plunger 230. The pump 200 can be constructed with the filter 270 integrally formed as part of the plunger 230, or a separate screen assembly can be installed as an add-on above a standard barrel 210 and plunger 230. The filter 270 can be an insert assembly that couples upper and lower sections of the plunger 230 together, or the filter 270 can be a plug-type insert that screws onto the plunger 230. The pump 200 can extend the life of a reciprocating rod lift system, reduce well maintenance costs, and increase overall production of an oil and gas well.

Figure 5:
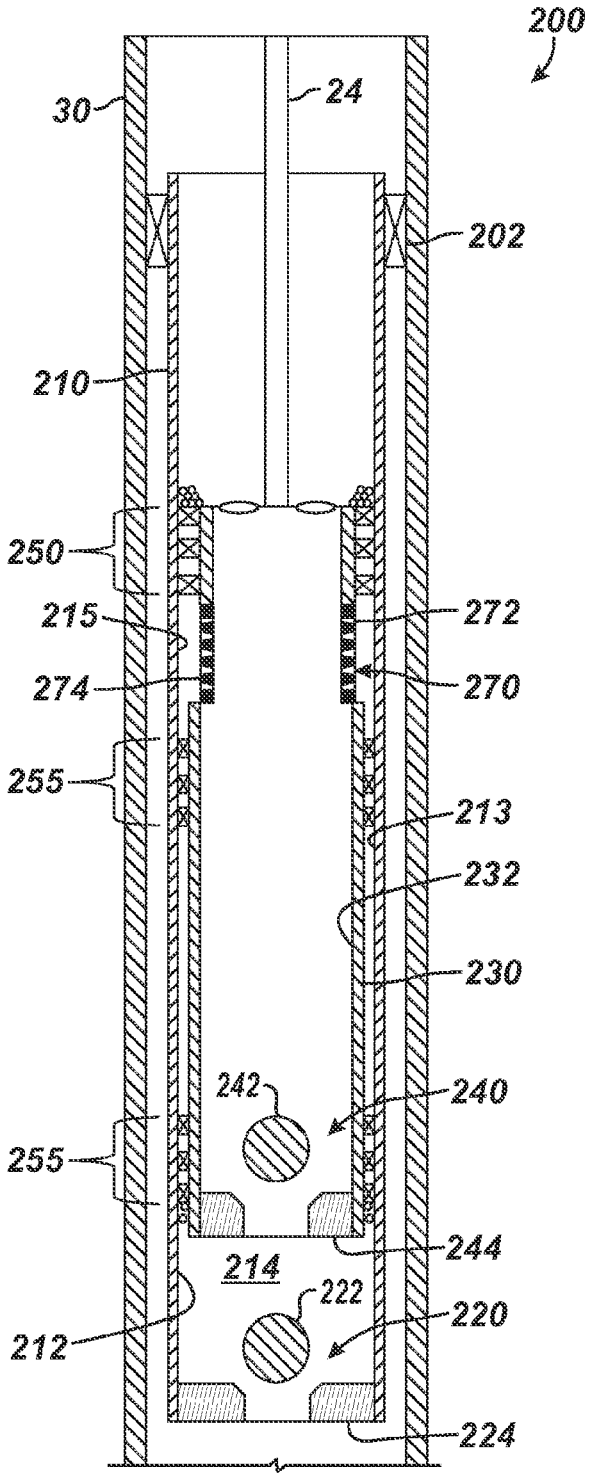
FIG. 5 illustrates the rod pump having another arrangement of seals.

FIG. 5 illustrates the rod pump 50 having another arrangement of seals. (The same reference numerals are used for similar components to the previous embodiments.) Rather than having a downhole seal that is a hydrodynamic or fluid seal as in the previous arrangement of FIG. 3, this pump 50 in FIG. 5 has a second seal 255 that is a mechanical seal having wiper seals. To deal with sand or the like, the wiper seals 255 are biased to restrict particulate slippage in one direction. For example, the wiper seals 255 are biased to restrict particulate slippage past the seal 255 and through the gap 213 towards the filter 270.

In another alternative, the rod pump 50 can have uphole and downhole seals that are both hydrodynamic seals (i.e., similar to seal 260 in FIG. 3). In yet another alternative, the rod pump 50 can have an opposite arrangement of seals than that shown in FIG. 3. In other words, the uphole seal can be a hydrodynamic seal (i.e., like seal 260 in FIG. 3), while the downhole seal can be a mechanical seal (i.e., like wiper seal 250 in FIG. 3). Although these alternatives are not illustrated, one skilled in the art will appreciate that features from one or more embodiments disclosed herein can be combined with features of one or more other embodiments disclosed herein.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole pump, comprising a barrel having a first one-way valve restricting fluid passage out of the barrel;

a plunger reciprocally disposed in the barrel and having first and second seals with the plunger and the barrel, the plunger having a second one-way valve restricting fluid passage out of an interior of the plunger and into a variable volume defined between the first and second one-way valves; and a screen disposed on the plunger between the first and second seals and separating the interior of the plunger from a gap between the plunger and the barrel, the screen permitting fluid passage between the interior and the gap and restricting particulate in the interior from passing into the gap, the screen comprising profiled wire forming a plurality of slotted openings, narrower portions of the slotted openings facing the interior of the plunger, where in a first stroke moving the barrel and the plunger relative to one another in a first direction, the variable volume decreases, the first one-way valve closes, and the second one-way valve opens, and where in the first stroke, fluid entering the interior of the plunger from the variable volume through the second one-way valve clears particulate adjacent a face of the wire on the screen exposed to the interior of the plunger.

2. The pump of claim 1, wherein the first seal comprises one or more wiper seals disposed outside the plunger and engaging inside the barrel.

3. The pump of claim 1, wherein the narrower portions of the slotted openings define a dimension, and wherein the gap defines an average clearance around an inside of the barrel and an outside of the plunger that is greater than or equal to the dimension of the slotted openings.

4. The pump of claim 3, wherein the screen prevents particulate greater than the dimension from passing through the slotted openings.

5. The pump of claim 1, wherein the screen of the profiled wire comprises a wire-wrapped screen at least partially disposed about the plunger.

6. The pump of claim 1, wherein the first one-way valve comprises a check valve having a ball movable relative to a seat.

7. The pump of claim 1, wherein the second one-way valve comprises a check valve having a ball movable relative to a seat.

8. The pump of claim 1, wherein in a second stroke moving the barrel and the plunger relative to one another in a second direction, the variable volume increases, the first one-way valve opens, and the second one-way valve closes.

9. The pump of claim 8, wherein in the second stroke, the screen permits fluid flow from the interior of the plunger to the gap and prevents at least some particulate in the interior of the plunger from passing out of the plunger and into the gap.

10. The pump of claim 1, wherein the second seal comprises a fluid seal formed with fluid disposed in the gap between the barrel and the plunger.

11. The pump of claim 1, wherein the second seal comprises a wiper seal disposed between the barrel and the plunger.

12. The pump of claim 11, wherein the wiper seal is biased to restrict particulate slippage in one direction.

13. The pump of claim 12, wherein the wiper seal is biased to restrict particulate slippage past the seal and through the gap towards the screen.

14. A reciprocating rod system, comprising:

a surface pump reciprocating a rod in a well; and a downhole pump disposed in a tubular in the well and actuated by the rod, the pump having— a barrel having a first one-way valve restricting fluid passage out of the barrel;

a plunger reciprocally disposed in the barrel and having first and second seals with the plunger and the barrel, the plunger having a second one-way valve restricting fluid passage out of an interior of the plunger and into a variable volume defined between the first and second one-way valves; and a screen disposed on the plunger between the first and second seals and separating the interior of the plunger from a gap between the plunger and the barrel, the screen permitting fluid passage between the interior and the gap and restricting particulate in the interior from passing into the gap, the screen comprising profiled wire forming a plurality of slotted openings, narrower portions of the slotted openings facing the interior of the plunger, where in a first stroke moving the barrel and the plunger relative to one another in a first direction, the variable volume decreases, the first one-way valve closes, and the second one-way valve opens, and where in the first stroke, fluid entering the interior of the plunger from the variable volume through the second one-way valve clears particulate adjacent a face of the wire on the screen exposed to the interior of the plunger.

15. The system of claim 14, wherein the first seal comprises one or more wiper seals disposed outside the plunger and engaging inside the barrel.

16. The system of claim 14, wherein the narrower portions of the slotted openings define a dimension, and wherein the gap defines an average clearance around an inside of the barrel and an outside of the plunger that is greater than or equal to the dimension of the slotted openings.

17. The system of claim 16, wherein the screen prevents particulate greater than the dimension from passing through the slotted openings.

18. The system of claim 14, wherein the screen of the profiled wire comprises a wire-wrapped screen at least partially disposed about the plunger.

19. The system of claim 14, wherein the first one-way valve comprises a check valve having a ball movable relative to a seat.

20. The system of claim 14, wherein the second one-way valve comprises a check valve having a ball movable relative to a seat.

21. The system of claim 14, wherein in a second stroke moving the barrel and the plunger relative to one another in a second direction, the variable volume increases, the first one-way valve opens, and the second one-way valve closes.

22. The system of claim 14, wherein in the second stroke, the screen permits fluid flow from the interior of the plunger to the gap and prevents at least some particulate in the interior of the plunger from passing out of the plunger and into the gap.

23. The system of claim 14, wherein the second seal comprises a fluid seal formed with fluid disposed in the gap between the barrel and the plunger.

24. The system of claim 14, wherein the second seal comprises a wiper seal disposed between the barrel and the plunger.

25. The system of claim 24, wherein the wiper seal is biased to restrict particulate slippage past the seal and through the gap towards the screen.

26. A method of producing fluid in a sandy well, comprising:

sealing a plunger disposed in a barrel with first and second seals;

transferring a first volume of fluid and particulate trapped in a first interior of the barrel into a second interior of the plunger by reciprocating the plunger and the barrel relative to one another in a first stroke in a first direction;

lifting uphole a second volume of fluid and particulate trapped in the second interior of the plunger by reciprocating the plunger and the barrel relative to one another in a second stroke in a second direction;

preventing particulate uphole of the plunger from passing in a gap between the plunger and the barrel using the first seal;

permitting fluid communication between the second interior of the plunger and the gap between the first and second seals; and preventing at least some particulate in the second interior of the plunger from passing out of the plunger and into the gap by screening particulate and fluid in the second interior of the plunger through a screen having profiled wire forming a plurality of slotted openings, narrower portions of the slotted openings facing the interior of the plunger; and clearing particulate adjacent a face of the wire on the screen exposed to the second interior of the plunger with the first volume of fluid transferring in the first stroke into the second interior of the plunger from the first interior of the barrel.

27. The method of claim 26, wherein sealing the plunger disposed in the barrel with the first and second seals comprises sealing the plunger with one or more wiper seals as the first seal disposed outside the plunger uphole of the screen and engaging inside the barrel.

28. The method of claim 26, wherein the narrower portions of the slotted openings define a dimension, and wherein the gap defines an average clearance around an inside of the barrel and an outside of the plunger that is greater than or equal to the dimension of the slotted openings.

29. The method of claim 28, wherein screening particulate and fluid in the second interior of the plunger through the screen comprises preventing particulate greater than the dimension from passing through the slotted openings.

30. The method of claim 26, wherein the screen of the profiled wire comprises a wire-wrapped screen at least partially disposed about the plunger.

31. The method of claim 26, wherein transferring the first volume of fluid and particulate trapped in the first interior of the barrel into the second interior of the plunger comprises closing a first one-way valve on the barrel and opening a second one-way valve on the plunger.

32. The method of claim 31, wherein lifting uphole the second volume of fluid and particulate trapped in the second interior of the plunger comprises closing the second one-way valve on the plunger and opening the first one-way valve.

33. The method of claim 26, wherein screening particulate and fluid in the second interior of the plunger through the screen comprises permitting fluid flow through the screen from the second interior of the plunger to the gap in the second stroke and preventing at least some particulate in the second interior of the plunger from passing through the screen, out of the plunger, and into the gap.

34. The method of claim 26, wherein sealing the plunger disposed in the barrel with the first and second seals comprises sealing the plunger with a fluid seal as the second seal disposed downhole of the screen and formed with fluid disposed in the gap between the barrel and the plunger.

35. The method of claim 26, wherein sealing the plunger disposed in the barrel with the first and second seals comprises sealing the plunger with a wiper seal as the second seal disposed downhole of the screen and disposed between the barrel and the plunger.

36. The method of claim 35, comprising restricting particulate slippage past the seal and through the gap towards the screen by biasing the wiper seal.

* * * * *